US008262407B2

(12) United States Patent
Mazzini et al.

(10) Patent No.: US 8,262,407 B2
(45) Date of Patent: Sep. 11, 2012

(54) ACTIVE COPPER CABLE EXTENDER

(75) Inventors: Marco Mazzini, Sesto San Giovanni (IT); Stefano Riboldi, Cinisello Balsamo (IT); Cristiana Muzio, Ivrea (IT)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 12/628,846

(22) Filed: Dec. 1, 2009

(65) Prior Publication Data

US 2011/0130032 A1 Jun. 2, 2011

(51) Int. Cl.
*H01R 11/00* (2006.01)

(52) U.S. Cl. ..... 439/502

(58) Field of Classification Search ..... 439/502, 439/578, 630, 676; 340/10.4
See application file for complete search history.

(56) References Cited

U.S. PATENT DOCUMENTS

| | | | | |
|---|---|---|---|---|
| 4,032,836 | A * | 6/1977 | Gross | 323/356 |
| 4,876,497 | A * | 10/1989 | Colver | 323/211 |
| 6,247,971 | B1 | 6/2001 | Lim | |
| 7,675,190 | B1 * | 3/2010 | Muller et al. | 307/3 |
| 2002/0116559 | A1 * | 8/2002 | Hoffman et al. | 710/64 |
| 2003/0228799 | A1 | 12/2003 | Machado et al. | |
| 2004/0073127 | A1 * | 4/2004 | Istvan et al. | 600/513 |
| 2005/0251002 | A1 * | 11/2005 | Istvan et al. | 600/393 |
| 2006/0210054 | A1 | 9/2006 | Stiscia | |
| 2007/0248024 | A1 | 10/2007 | Conway et al. | |
| 2008/0056284 | A1 | 3/2008 | Powell et al. | |
| 2008/0232397 | A1 | 9/2008 | Muth | |
| 2009/0124128 | A1 * | 5/2009 | Regnier | 439/630 |
| 2009/0191750 | A1 * | 7/2009 | Kadar-Kallen et al. | 439/578 |
| 2009/0209125 | A1 * | 8/2009 | Bright et al. | 439/352 |
| 2009/0225979 | A1 | 9/2009 | Pelletier et al. | |
| 2010/0052863 | A1 * | 3/2010 | Renfro et al. | 340/10.4 |
| 2010/0080554 | A1 * | 4/2010 | Aguren | 398/20 |

OTHER PUBLICATIONS

Molex, "SFP+ 10 Gbps Interconnect System," 2008: pp. 1-4, <http://www.molex.com/cmc_upload/0/000/-18/001/ds_sfp+.pdf>.
Quellan, "SFP+ Active Copper Cable," 2009: pp. 1-9, <http://www.quellan.com/pdfs/quellan-sfp+active-cable.pdf>.
Philip Gadd, "Actice copper cables for 10-Gbit data rates," Sep. 2009, Quellan, Santa Clara, California: pp. 1-4, <http://www2.electronicproducts.com/Active_copper_cables_for_10-Gbit_data_rates-article-FAJH_Cable_Sept2009-html.aspx>.
Seagate, "SFF-8431 Specifications for Enhanced Small Form Factor Pluggable Module SFP+," Jul. 2009: pp. 1-132, <ftp://ftp.seagate.com/sff/SFF-8431.PDF>.
Vitesse, "Technology Innovations: The Need for Speed," OFC/NFOEC 2008: pp. 1-2, <http://www.vitesse.com/flexeq/flexeq/media/edcnewsletter.pdf>.
International Search Report for International Application No. PCT/US2010/058067 dated Feb. 10, 2011.

* cited by examiner

*Primary Examiner* — Jean F Duverne
(74) *Attorney, Agent, or Firm* — Patterson & Sheridan, LLP

(57) ABSTRACT

Methods and apparatus for reducing distortion in signals propagating through cables at data rates of at least 10 gigabits per second (Gbps) are provided. By connecting such direct attach cables with an active cable extender assembly described herein, data signals may be reshaped, retimed, and/or emphasized in an effort to increase the cable length between network devices while still complying with the signal quality requirements of communication standards, such as the SFF-8431 MSA, the SFF-8461 MSA, and the IEEE 802.3ba CR4/10 standards for Ethernet communications. Copper cable solutions with such increased cable length possible between network devices may provide substantial cost reduction when compared to optical cable solutions. Furthermore, by potentially increasing the signal quality effectively transmitted by a host, solutions utilizing embodiments of the present invention may guarantee host-to-host interoperability.

20 Claims, 4 Drawing Sheets

ACTIVE COPPER CABLE EXTENDER

TECHNICAL FIELD

Embodiments of the present invention generally relate to wired network communications and, more particularly, to an active cable extender assembly for extending the effective length of a direct attach cable assembly.

BACKGROUND

Network communications demand ever-increasing amounts of transmitted information, and network technologies for higher data rates have been and continued to be developed. For example, the Gigabit Ethernet standard has been available for some time and is quite common. The Gigabit Ethernet standard specifies communicating using Ethernet technology at data rates of at least one Gigabit per second (Gbps), and both optical and copper-based solutions have been implemented to comply with the standard. At 1 Gbps or greater, optical cables tend to be used for longer distances, whereas copper cables tend to be used more for shorter distances due in large part to the promulgation of the 1000 Base-T standard, which permits 1 Gbps communication over standard Category 5 ("Cat-5") unshielded twisted-pair network cable.

Presently, data rates of at least 10 Gbps have been standardized, while technologies and standards are being developed for 40 Gbps and 100 Gbps data rates using Ethernet technology. As these data rates increase, copper-based solutions become more difficult to realize. For example, the permissible copper cable length becomes shorter or the transmission power requirements increase as the data rate increases due to distortion effects introduced by the high speed signal propagating through the cable. However, because of the cost of current optical solutions, interest in copper-based solutions persists, even at these higher data rates.

OVERVIEW

Embodiments of the present invention generally relate to an active cable extender assembly or adapter for wired network communications at data rates of at least 10 Gigabits per second (Gbps).

One embodiment of the present invention provides an apparatus. The apparatus generally includes an electrical link, a male connector coupled to a first end of the link, and a female connector coupled to a second end of the link. The female connector typically includes a connector receptacle compatible with data rates of at least 10 Gbps and an active circuit for reducing signal distortion, coupled between the second end of the link and the connector receptacle.

Another embodiment of the present invention provides a method. The method generally includes transmitting a signal into an electrical assembly—wherein the electrical assembly typically includes an electrical link, a male connector coupled to a first end of the link, and a female connector coupled to a second end of the link, the female connector having a connector receptacle compatible with data rates of at least 10 Gbps and an active circuit for reducing signal distortion, coupled between the second end of the link and the connector receptacle—and reducing distortion in the signal as the signal passes through the active circuit of the female connector.

Yet another embodiment of the present invention provides a system. The system generally includes a host, a network access element, and first and second electrical assemblies for transmitting signals between the host and the access element.

The second electrical assembly typically includes an electrical link, a male connector coupled to a first end of the link, and a female connector coupled to a second end of the link, the female connector having a connector receptacle compatible with data rates of at least 10 Gbps and connected with the first electrical assembly and an active circuit for reducing signal distortion, coupled between the second end of the link and the connector receptacle.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DESCRIPTION OF EXAMPLE EMBODIMENTS

Embodiments of the present invention provide methods and apparatus for reducing distortion in signals propagating through cables at data rates of at least 10 gigabits per second (Gbps). By connecting such direct attach cables with an active cable extender assembly described herein, data signals may be reshaped, retimed, and/or emphasized in an effort to increase the cable length between network devices while still complying with the signal quality requirements of communication standards, such as the SFF-8431 MSA, the SFF-8461 MSA, and the IEEE 802.3ba CR4/10 standards. Copper cable solutions with such increased cable length possible between network devices may provide substantial cost reduction when compared to optical cable solutions. Furthermore, by potentially increasing the signal quality effectively transmitted by a host, solutions utilizing embodiments of the present invention may guarantee host-to-host interoperability.

An Example System

Figure 1A:
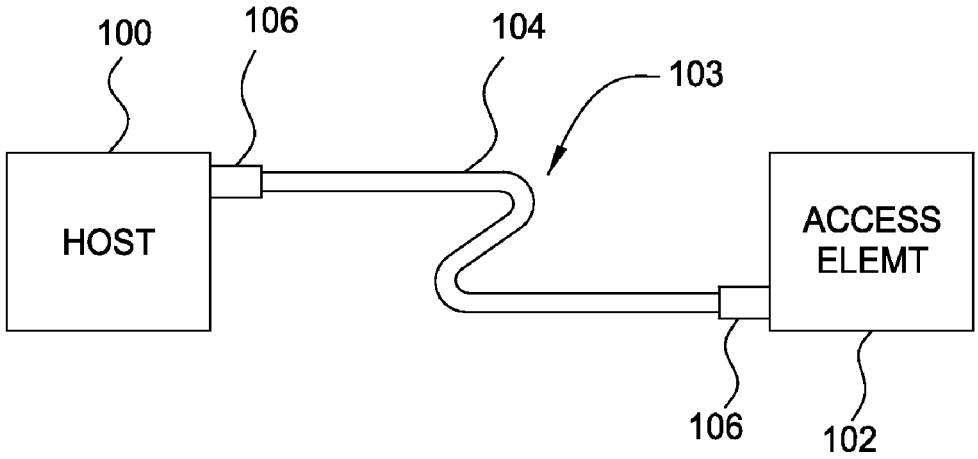
FIG. 1A illustrates a portion of a network for transmitting data at rates of at least 10 Gigabits per second (Gbps) and depicts a direct attach cable assembly connecting a host to a network access element.

FIG. 1A illustrates a portion of a network, such as a local area network (LAN), for transmitting data at rates of at least 10 Gbps. For example, the network may operate according to any of various suitable Institute of Electrical and Electronics Engineers (IEEE) 802.3 standards for wired Ethernet (e.g., IEEE 802.3an) and/or according to any of various suitable Multi-Source Agreements (MSAs), such as the SFF-8431 MSA.

FIG. 1A depicts a host 100 connected to a network access element 102 via a direct attach cable assembly 103. The host 100 may comprise any suitable computer acting as a source of information or signals, such as a server or a client computer. The access element 102 may comprise any suitable device for accessing the network, such as a network interface card (NIC) or a switch. As one example, the host may be a server, and the access element 102 may comprise a top of rack switch.

As an electrical assembly, the direct attach cable assembly 103 may comprise a cable 104, such as copper cable, and a male connector 106 on each end of the cable 104. For high speed Ethernet communications of at least 10 Gbps, the male connectors 106 may comprise enhanced small form factor pluggable (SFP+) or quad small form factor pluggable (QSFP) connectors, for example.

For 10 Gbps Ethernet communication, the physical layer transmitters may not be well-controlled or good enough to fully comply with the SFF-8431 MSA, especially as the transmission length increases. The signal quality from such transmitters is currently the most limiting factor on the cable length that may practically be used. In order to comply with the current SFF-8431 MSA, which defines the 10 Gbps direct attach copper cable assembly, the cable 104 may be limited in length to 7 m. This limitation may likely become more problematic (i.e., the allowed cable length may be further reduced) as 40 Gbps (and especially 100 Gbps) data rate standards are issued.

Figure 1B:
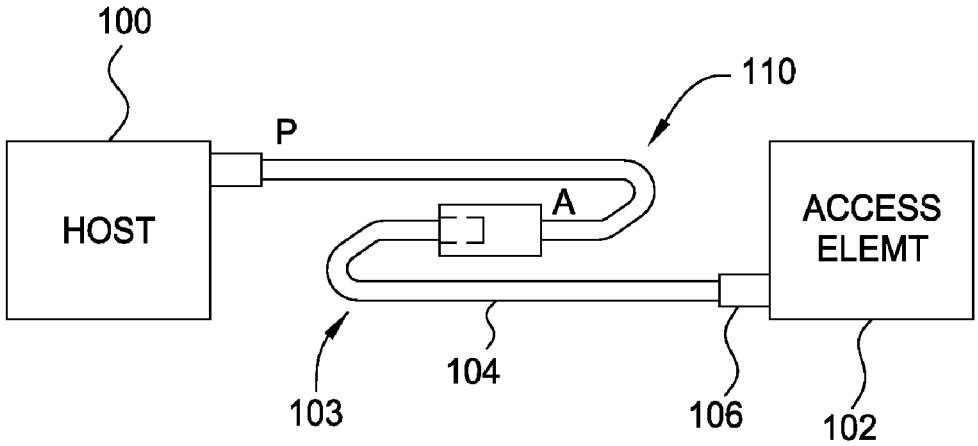
FIG. 1B illustrates connecting the host to the access element of FIG. 1A with the direct attach cable assembly and a cable extender assembly, in accordance with an embodiment of the present invention.

One way to overcome this cable length limitation may be to connect an electrical assembly, such as an active cable extender assembly 110, to the direct attach cable assembly 103, as shown in FIG. 1B. The active cable extender assembly 110 may be connected between the host 100 and the direct attach cable assembly 103. Such an active cable extender assembly may reshape the electrical signals propagating therethrough in an effort to have the reshaped signals at the host 100 or the access element 102 comply with the SFF-8431 MSA, the SFF-8461 MSA, and/or the IEEE 802.3ba for 40 GBASE-CR4/100 GBASE-CR10 (CR4/10) standard. In this manner, the cable length between the host 100 and the access element 102 may be increased while still complying with the relevant communications standard, among other advantages described below.

An Example Cable Extender

Figure 2:
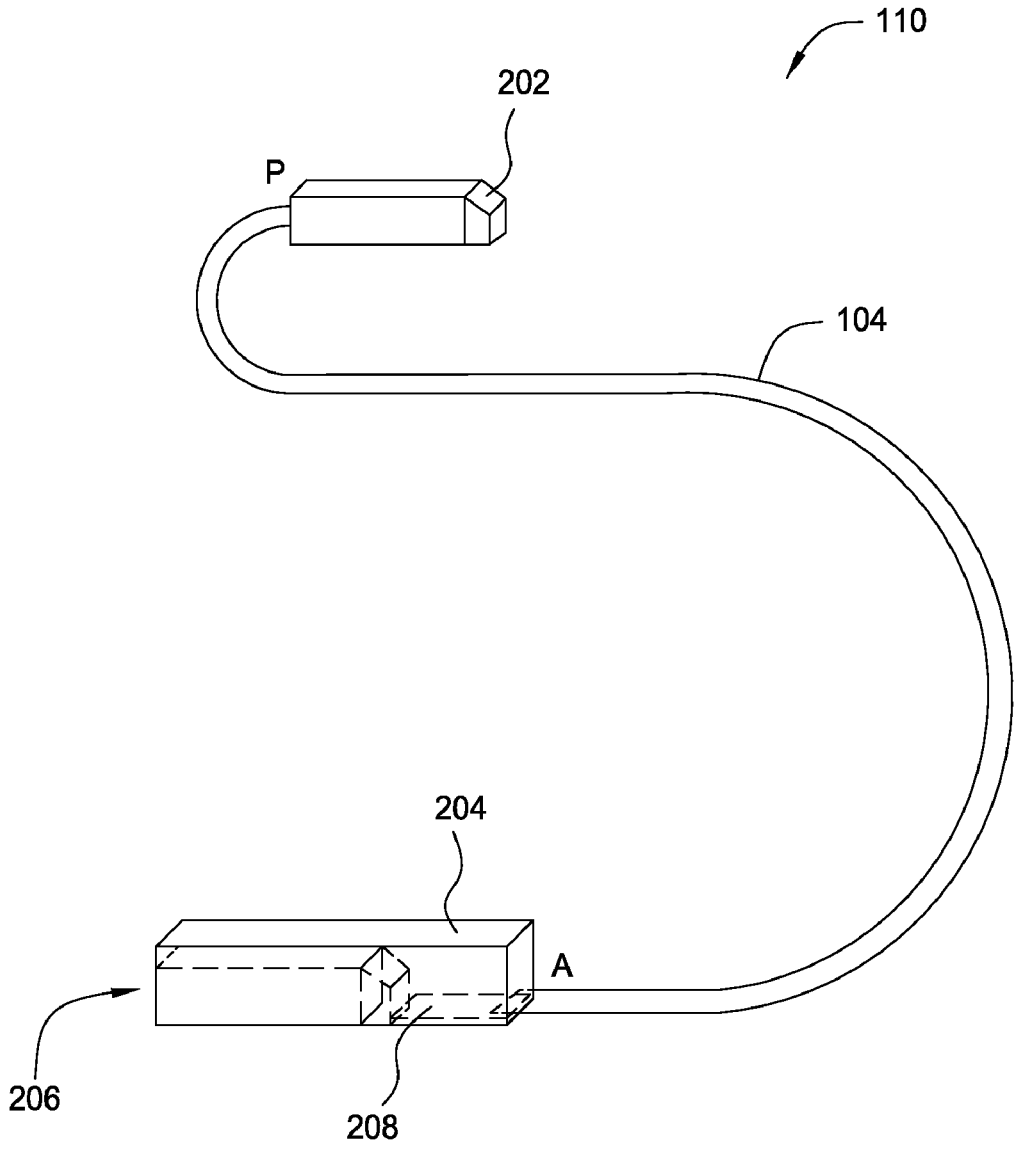
FIG. 2 illustrates the cable extender assembly of FIG. 1B in greater detail, in accordance with an embodiment of the present invention.

FIG. 2 illustrates the cable extender assembly 110 of FIG. 1B in greater detail, in accordance with an embodiment of the present invention. The cable extender assembly may comprise a passive side (labeled "P" in the figures) with a male connector 202, an active side (labeled "A" in the figures) with a female connector 204, and an electrical link or other coupling (e.g., a certain length of cable 104 or various other suitable wired connections) between the two connectors 202, 204. For example, the cable 104 in the cable extender assembly 110 may have a length of 7 m, similar to the typical cable length of the direct attach cable assembly 103. However, the cable extender assembly 110 may have a longer or shorter length than the direct attach cable assembly 103 for some embodiments.

For other embodiments, the cable extender assembly 110 may appear more like an adapter, having a short electrical link coupling the two connectors 202, 204 together. For such embodiments, the electrical link may comprise a ribbon cable or a printed circuit board (PCB) with traces running between the two connectors, for example.

The male connector 202 at one end of the cable may comprise any of various suitable male connectors compliant with high speed Ethernet communications of at least 10 Gbps. For example, the male connector 202 may comprise an SFP+ or a QSFP/CX connector and may be capable of being plugged into any host supporting a CX1 direct attach interface or a CR4/10 QSFP interface. The male connector 202 may be compliant to the SFF-8431 MSA and SFF-8461 MSA standards.

The female connector 204 (also called a cage) at the other end of the cable may house a connector receptacle 206 and an active circuit 208 for reducing distortion in signals propagating between the cable 104 and the connector receptacle in either direction. The connector receptacle 206 may be any of various suitable female connectors for receiving a male connector compliant with high speed Ethernet communications of at least 10 Gbps. For example, the connector receptacle 206 may comprise a female SFP+ or QSFP connector for receiving a male SFP+ or QSFP connector, respectively.

Figure 3:
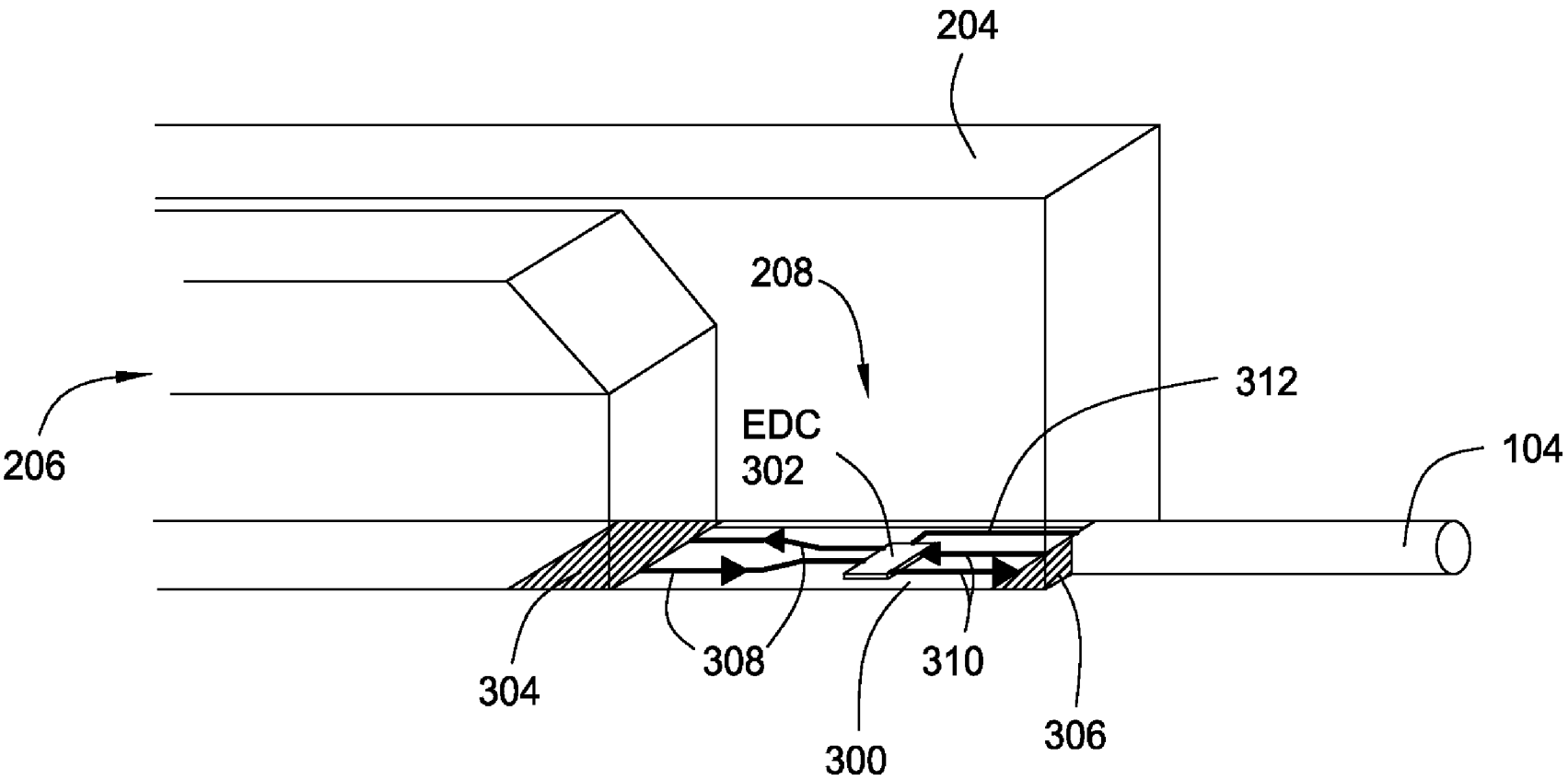
FIG. 3 illustrates the active side of the cable extender assembly of FIG. 2 in greater detail, in accordance with an embodiment of the present invention.

FIG. 3 illustrates the female connector 204 housing the connector receptacle 206 and the active circuit 208 of FIG. 2 in greater detail. For some embodiments, the active circuit 208 may be mounted on a printed circuit board (PCB) 300 comprising of various suitable materials, such as FR4. The active circuit 208 may comprise any circuitry suitable for reducing distortion in signals propagating through the active circuit. For some embodiments, the active circuit 208 may reduce distortion introduced by copper cable, but may not reduce distortion due to fiber optic cable. The active circuit 208 may comprise, for example, at least one integrated circuit (IC), such as an Electronic Dispersion Compensator (EDC) 302. The EDC 302 may function similar to an equalizer (EQ), using various weighted FFE/DFE taps to reshape, retime, and/or emphasize signals propagating through the EDC. For some embodiments—or at least in certain directions as will be described below—the active circuit 208 may comprise a simple retiming and reshaping stage.

The PCB 300 may comprise any suitable connector interface 304 for electrically connecting the connector receptacle 206 with the PCB. Similarly, the PCB 300 may comprise any suitable cable interface 306 for connecting the cable 104 with the PCB. Traces 308 fabricated in or on the PCB 300 may connect the connector interface 304 with the EDC 302, while traces 310 may connect the EDC 302 with the cable interface 306.

Furthermore, the active circuit 208 (e.g., the EDC 302) may be powered via one or more power supply rails 312 routed through the cable extender assembly 110 and provided as traces on the PCB 300. For example, the host 100 may supply power to one or more pins of the male connector 202, and these pins may be connected with the power supply rails 312 via one or more wires or other suitable connections through the cable 104 and the cable interface 306. The power pins of the male connector 202 used to supply power to the active circuit 208 may be specified by one of the MSAs (e.g., SFF-8431 or SFF-8461) to supply power to the optic interfaces. Such pins may be capable of supplying 1 A of current via a 1 V rail, which may be sufficient to power the EDC 302 or other active circuitry in the female connector 204.

Various circuits supporting the active circuit 208, the connector interface 304, and/or the cable interface 306 may be mounted on the PCB 300 or otherwise disposed within the female connector 204. This support circuitry may include active and/or passive electrical components.

Example Data Transmission with the Cable Extender

Figure 4:
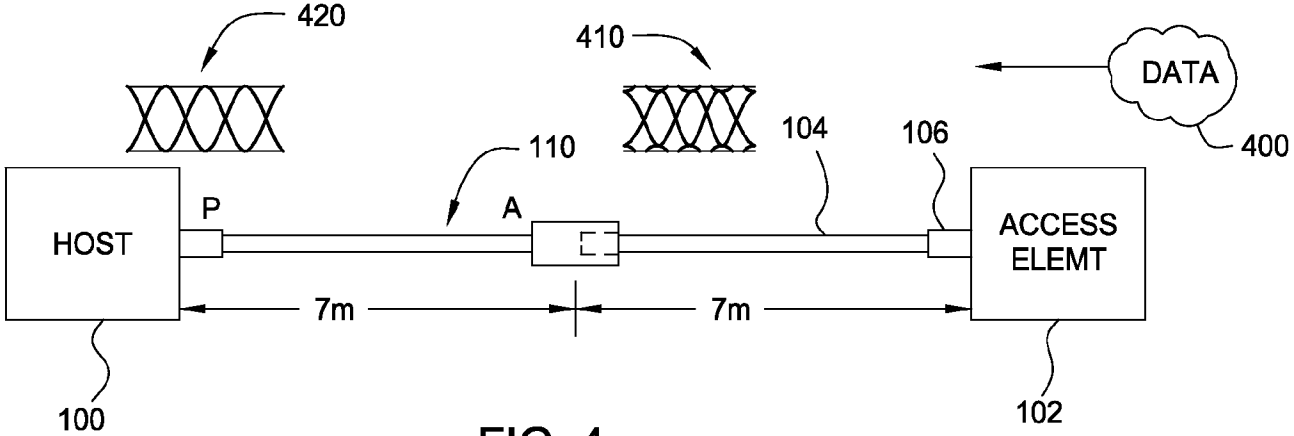
FIG. 4 illustrates transmitting data through the portion of the network depicted in FIG. 1B and reducing distortion as the data travels from the access element to the host through the cable extender assembly, in accordance with an embodiment of the present invention.

FIG. 4 illustrates the transmission of data 400 from an access element 102 to the host 100 using a direct attach cable assembly 103 plugged into the active side (A) of the cable extender assembly 110 via the connector receptacle 206. The data 400 from the access element 102 may not be well controlled, and therefore, the signal transmitted therefrom may be distorted. Furthermore, as the signal propagates through the direct attach cable assembly 103, the signal may become further distorted, as illustrated in the eye diagram 410.

The active circuit 208 in the female connector 204 (including the EDC 302, for example) may compensate the distorted signal received from the direct attach cable assembly 103 via the connector interface 304. After compensation, a clean, reshaped, retimed, and/or emphasized signal may be sent through the cable interface 306, the cable 104, and the passive side (P) of the cable extender to the host 100. In this manner, the signal reaching the host 100 may have reduced distortion compared to a similar length of passive cable between the host and the access element 102, thereby allowing for an increased cable length (e.g., 14 m) between the host and access element. Eye diagram 420 illustrates the example distortion reduction of the cable extender assembly 110. Moreover, because the properties of the fixed length of cable 104 in the cable extender assembly 110 are known, the active circuit 208 may compensate the signal propagated from the access element 102 such that the signal reaching the host 100 is compliant with the SFF-8431 MSA, SFF-8461 MSA, and/or the IEEE 802.3ba for CR4/10 standards. For example, the output of the active circuit 208 on the transmitting side of the cable interface 306 may be set to an appropriate emphasis level in an effort to increase the signal quality of the data 400 received at the host after propagation through the cable extender assembly.

Figure 5:
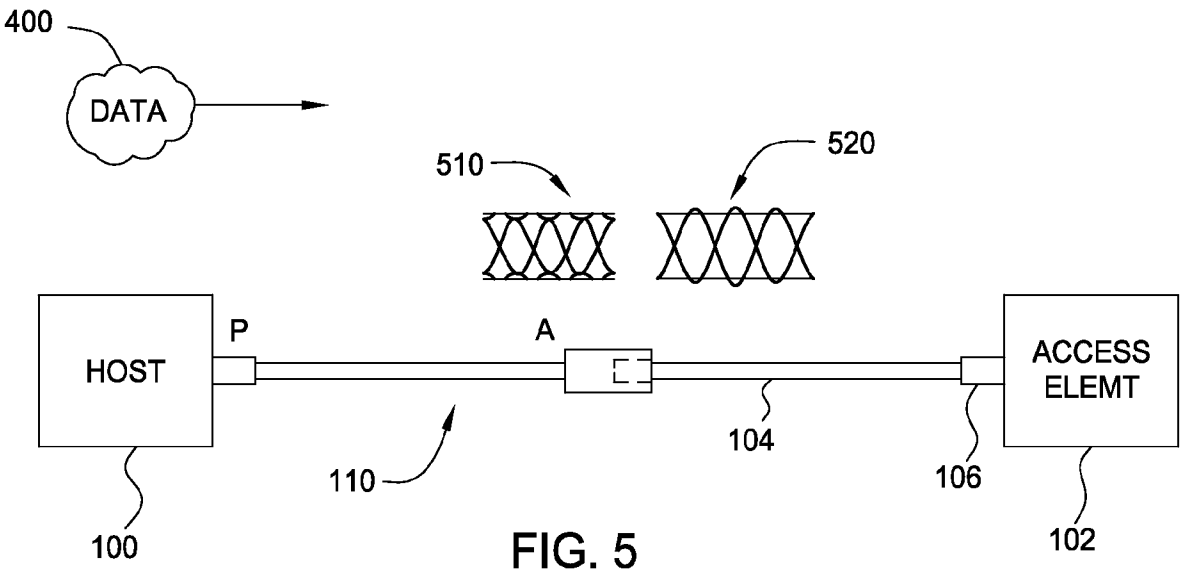
FIG. 5 illustrates transmitting data through the portion of the network depicted in FIG. 1B and reducing distortion as the data travels from the host to the access element through the cable extender assembly, in accordance with an embodiment of the present invention.

FIG. 5 illustrates signal propagation of data 400 in the opposite direction, from the host 100 to the access element 102. The host may transmit the data signals into the passive side (P) of the cable extender assembly 110, and the signals may become distorted from propagation through the extender cable, as illustrated in eye diagram 510. The active circuit 208 may receive the distorted signals via the cable interface 306 and compensate, or at least reduce, the distortion introduced by the propagation in the extender cable. However, if the extender cable is of good quality, the active circuit 208 may comprise a simple retiming and reshaping stage to clean and recover the signal, rather than an EDC 302. The simple stage may be suitable in this direction because the signal to be compensated is fed to the active circuit 208 through a known cable. In the other direction of FIG. 4, however, the active circuit 208 may most likely use a more powerful algorithm or utilize more aggressive circuitry than a simple retiming and reshaping stage in order to compensate the distortion introduced from propagation through any type of qualified direct attach cable assembly 103.

Returning to the direction of data transmission of FIG. 5, the active circuit 208, after recovering and reshaping, may transmit a cleaner retimed, reshaped, and/or emphasized signal to the connector interface 304. This cleaner emphasized signal (illustrated in eye diagram 520) may then be propagated through the direct attach cable assembly 103 connected with the active side (A) of the cable extender assembly 110. This means that signals having at least the same or a cleaner eye than those coming directly from the host and transmitted into the cable extender assembly are provided to the direct attach cable assembly and the access element.

In this manner, the cable length between the host and the access element may be increased up to 14 m, for example, without any changes to the device hardware or firmware upgrades. Furthermore, the cable extender assembly 110 described above may provide substantial cost savings since the combined cost of the passive direct attach cable and cable extender assemblies is less than half the cost of short reach optical cable solutions. Most users do not require the significantly greater length capability of optical solutions, even though the 7 m length limitation of contemporary passive copper cable solutions for data communications of at least 10 Gbps may not be sufficient for such users. Embodiments of the cable extender assembly described herein may offer a solution allowing for increased cable length between network devices, while maintaining signal quality compliance with various communications standards supporting data rates of at least 10 Gbps, such as the SFF-8431 MSA, the SFF-8461 MSA, and the IEEE 802.3ba for CR4/10 standards.

Moreover, by providing at least the same or increased signal quality compared to the signal quality transmitted directly by the host, embodiments of the active cable extender assembly described herein may guarantee host-to-host interoperability, such as between different types of hosts from the same vendor or between hosts manufactured by different vendors. Furthermore, embodiments of the active cable extender assembly permit using long copper cable between network devices even if the host EDC alone is not capable of guaranteeing compliance and signal propagation quality. For example, a host guaranteeing CX1 compliance only up to 3 m may be extended up to 10 m by utilizing an active cable extender assembly having a length of 7 m.

For some embodiments, the active cable extender assembly may be connected with any cable type. For example, the cable extender assembly may be connected with an optical active cable. In this case, the active side (A) may function as a media converter, too, converting signals between the electrical and optical domains as signals are propagated through the active circuit and increased in signal quality.

While the foregoing is directed to embodiments of the present disclosure, other and further embodiments of the disclosure may be devised without departing from the basic scope thereof, and the scope thereof is determined by the claims that follow.

The invention claimed is:

1. An apparatus comprising:

an electrical cable comprising a data link and a power link;

a male connector coupled to a first end of the data link and a first end of the power link; and a female connector coupled to a second end of the data link and a second end of the power link, wherein the female connector comprises:

a connector receptacle compatible with data rates of at least 10 gigabits per second (Gbps); and an active circuit that reduces signal distortion in signals that transfer data in the data link at data rates of at least 10 Gbps, coupled between the second end of the data link and the connector receptacle, wherein the power link is configured to provide power used to operate the active circuit.

2. The apparatus of claim 1, wherein the connector receptacle comprises an enhanced small form factor pluggable (SFP+) or a quad small form factor pluggable (QSFP) connector receptacle.

3. The apparatus of claim 2, wherein the male connector comprises an SFP+ or a QSFP connector.

4. The apparatus of claim 1, wherein the active circuit comprises an Electronic Dispersion Compensator (EDC).

5. The apparatus of claim 1, wherein the active circuit comprises a retiming and reshaping stage.

6. The apparatus of claim 1, wherein the male connector comprises a pin coupled to the first end of the power link, the pin is configured to receive power from a host, and wherein the male connector is configured to receive an at least 10 Gbps data signal from the host that is transmitted on the data link.

7. The apparatus of claim 1, wherein the active circuit is disposed on a printed circuit board (PCB) disposed within the female connector and having traces connecting the active circuit with the connector receptacle and with the data link.

8. The apparatus of claim 1, wherein the electrical cable comprises copper cable.

9. The apparatus of claim 1, wherein the electrical cable has a length of at least 7 m.

10. A method comprising:

transmitting a signal into an electrical assembly, wherein the electrical assembly comprises:

an electrical cable comprising a data link and a power link;

a male connector coupled to a first end of the data link and to a first end of the power link; and a female connector coupled to a second end of the data link and to a second end of the power link, wherein the female connector comprises:

a connector receptacle compatible with data rates of at least 10 gigabits per second (Gbps); and an active circuit that reduces signal distortion in signals that transfer data in the data link at data rates of at least 10 Gbps, coupled between the second end of the data link and the connector receptacle;

delivering power used to operate the active circuit via the power link; and reducing distortion in the signal as the signal passes through the active circuit of the female connector.

11. The method of claim 10, wherein the connector receptacle comprises an enhanced small form factor pluggable (SFP+) or a quad small form factor pluggable (QSFP) connector receptacle.

12. The method of claim 10, wherein the male connector comprises a pin coupled to the first end of the power link, the pin configured to receive power from a host, and wherein the male connector is configured to receive an at least 10 Gbps data signal from the host that is transmitted on the data link.

13. The method of claim 10, wherein reducing the distortion in the signal comprises using Electronic Dispersion Compensation (EDC).

14. The method of claim 10, wherein reducing the distortion in the signal comprises retiming and reshaping the signal.

15. A system comprising:

a host;

a network access element; and first and second electrical assemblies for transmitting signals between the host and the access element, wherein the second electrical assembly comprises:

an electrical cable comprising a data link and a power link;

a male connector coupled to a first end of the data link and a first end of the power link; and a female connector coupled to a second end of the data link and a second end of the power link, wherein the female connector comprises:

a connector receptacle compatible with data rates of at least 10 gigabits per second (Gbps) and connected with the first electrical assembly; and an active circuit that reduces signal distortion in signals that transfer data in the data link at data rates of at least 10 Gbps, coupled between the second end of the data link and the connector receptacle, wherein the power link is configured to provide power used to operate the active circuit.

16. The system of claim 15, wherein the connector receptacle comprises an enhanced small form factor pluggable (SFP+) or a quad small form factor pluggable (QSFP) connector receptacle.

17. The system of claim 15, wherein the transmission of the signals between the host and the access element through the first and second electrical assemblies is compliant with at least one of the SFF-8431 multi-source agreement (MSA), the SFF-8461 MSA, or the Institute of Electrical and Electronics Engineers (IEEE) 802.3ba standard for 40 GBASE-CR4 or 100 GBASE-CR10.

18. The system of claim 15, wherein the host is configured to deliver power to the active circuit via a pin in the male connector, the pin is connected to the first end of the power link, and wherein the male connector receives an at least 10 Gbps data signal from the host that is transmitted on the data link.

19. The system of claim 15, wherein the access element comprises a switch, and wherein the first electrical assembly comprises a different electrical cable, a different male connector, and a different female connector, wherein the different male connector is configured to couple to the female connector of the second electrical assembly and the different female connector is configured to couple to the access element.

20. The system of claim 15, wherein the access element comprises a network interface card (NIC).

* * * * *